US010539035B2

(12) United States Patent
Simeone et al.

(10) Patent No.: US 10,539,035 B2
(45) Date of Patent: Jan. 21, 2020

(54) COMPLIANT ROTATABLE INTER-STAGE TURBINE SEAL

(71) Applicant: General Electric Company, Schenectady, NY (US)

(72) Inventors: Peter Andrew Simeone, Byfield, MA (US); Robert Clayton von der Esch, Ipswich, MA (US)

(73) Assignee: General Electric Company, Schenectady, NY (US)

( * ) Notice: Subject to any disclaimer, the term of this patent is extended or adjusted under 35 U.S.C. 154(b) by 223 days.

(21) Appl. No.: 15/637,259

(22) Filed: Jun. 29, 2017

(65) Prior Publication Data

US 2019/0003326 A1 Jan. 3, 2019

(51) Int. Cl.

| | |
|---|---|
| ***F01D 25/12*** | (2006.01) |
| ***F01D 11/00*** | (2006.01) |
| ***F01D 11/02*** | (2006.01) |
| ***F01D 5/08*** | (2006.01) |

(52) U.S. Cl.

CPC ..... *F01D 11/008* (2013.01); *F01D 5/081* (2013.01); *F01D 11/02* (2013.01); *F01D 25/12* (2013.01)

(58) Field of Classification Search

None

See application file for complete search history.

(56) References Cited

U.S. PATENT DOCUMENTS 4,365,816 A * 12/1982 Johnson ..... F16J 15/363 277/379
5,236,302 A 8/1993 Weisgerber et al.
5,537,814 A 7/1996 Nastuk et al.
5,555,721 A 9/1996 Bourneuf et al.
5,749,701 A 5/1998 Clarke et al.
5,941,531 A * 8/1999 Parker ..... F16J 15/3484 277/361
6,220,815 B1 4/2001 Rainous et al.
6,398,488 B1 6/2002 Solda et al.
6,464,453 B2 10/2002 Toborg et al.
6,575,703 B2 6/2003 Simeone et al.
6,761,529 B2 * 7/2004 Soechting ..... F01D 5/187 415/115
8,087,249 B2 1/2012 Ottaviano et al.
8,087,880 B2 1/2012 Karafillis et al.
8,147,178 B2 4/2012 Ottaviano et al.
(Continued)

*Primary Examiner* — Michael Lebentritt

(74) *Attorney, Agent, or Firm* — General Electric; Pamela Kachur

(57) ABSTRACT

Compliant bellow seal may be axially disposed between first and second cooling plates bounding first and second cooling passages between cooling plates and first and second stage disks in turbine. Bellow seal includes two or more convolutions with oppositely facing forward and aft sealing surfaces, which may be flat, on forward and aft annular sealing walls and cylindrical annular outer and inner contact and sealing surfaces on and facing radially outwardly or inwardly from one of the convolutions. A snake bellow seal embodiment may have at least two of the convolutions being full convolutions of unequal width and a forwardmost partial convolution including the sealing wall.

Bellow seal may allow turbine cooling flow from an inter-stage radial face spline to flow through inner openings of second cooling passage and block first stage disk cooling air from flowing through inner openings of first cooling passage.

24 Claims, 7 Drawing Sheets

(56) References Cited

U.S. PATENT DOCUMENTS

| | | | | |
|---|---|---|---|---|
| 8,240,986 | B1 * | 8/2012 | Ebert | F01D 11/001 415/173.2 |
| 2004/0026873 | A1 * | 2/2004 | Davey | F16L 37/252 277/608 |
| 2005/0053464 | A1 * | 3/2005 | Simeone | F01D 5/025 416/97 R |
| 2005/0123389 | A1 * | 6/2005 | Morris | F01D 9/04 415/1 |
| 2007/0187634 | A1 * | 8/2007 | Sneh | F16K 7/14 251/30.01 |
| 2007/0217904 | A1 * | 9/2007 | Dixon | F01D 5/081 415/116 |
| 2015/0184614 | A1 * | 7/2015 | Langenfeld | F16J 3/06 60/517 |
| 2015/0337968 | A1 * | 11/2015 | Strand | F16K 5/06 251/315.01 |
| 2016/0146248 | A1 * | 5/2016 | Ertas | F16C 32/0622 384/105 |
| 2016/0201832 | A1 * | 7/2016 | Barbely | F16L 27/11 285/226 |
| 2017/0009604 | A1 * | 1/2017 | Morris | F02C 7/32 |

* cited by examiner

COMPLIANT ROTATABLE INTER-STAGE TURBINE SEAL

BACKGROUND OF THE INVENTION

Technical Field

The present invention relates generally to gas turbine engine inter-stage seals, more specifically, to inter-stage seals used to provide sealing of inter-stage cavities of a turbine.

Background Information

Gas turbine engines often have inter-stage seals in turbines of the engine. Some turbine inter-stage cavities are sealed to separate first stage blade cooling supply air from second stage blade cooling supply. It is known in the art to use seal wires to provide sealing at such locations. However, a seal wire has end gaps that allow a leakage to occur. Seal wires are also often mistakenly left out of the assembly allowing a large leakage to occur. In some applications, several seal wires may be required to seal a cavity. In some gas turbine engines, the inter-stage cavity of a turbine rotor needs to be sealed to separate blade cooling flows and purge flows. Such sealing is typically achieved using one or more seal wires. Thus, there is a need for turbine inter-stage seals that eliminate seal wires and the inherent leakage they allow. There is also a need for turbine inter-stage seals that prevent mistakenly leaving seals out of the assembly which allows a large leakage to occur. There is also a need for such seals in inter-stage cavities of gas engine turbine rotors to seal and separate blade cooling flows and purge flows.

BRIEF DESCRIPTION OF THE INVENTION

A compliant bellow seal includes two or more convolutions circumscribed about an axis of rotation, oppositely facing forward and aft sealing surfaces on axially spaced apart forward and aft annular legs or sealing walls, and a cylindrical annular contact and sealing surface on and facing radially outwardly or inwardly with respect to the axis of rotation from one of the convolutions.

The bellow seal may further include the outer contact and sealing surface being located on a radially outwardly extending cylindrical extension on one of the convolutions and the forward and aft sealing surfaces being flat.

The bellow seal may be a snake bellow seal having at least two of the convolutions being full convolutions of unequal width and a forwardmost partial convolution including the forward annular leg or sealing wall. The outer contact and sealing surface may be located on a radially inwardly extending cylindrical extension on a bend of the forwardmost partial convolution.

The bellow seal may be used in a turbine assembly including first and second cooling plates mounted on first and second stage disks respectively, first and second cooling passages disposed between the first and second cooling plates and the first and second stage disks respectively, and the first and second cooling plates and the first and second stage disks circumscribed about an axis of rotation. The annular compliant bellow seal is circumscribed about the axis of rotation and may be axially disposed between the first and second cooling plates.

The bellow seal may surround a plenum and an inter-stage radial face spline between disk shaft extensions extending axially from the first and second stage bores of first and second stage disks respectively of the turbine assembly. The turbine assembly may include inner openings to the first and second cooling passages respectively and the bellow seal may be operable to direct or allow turbine cooling flow from the inter-stage radial face spline to flow through the plenum and through the inner openings of the second cooling passage. The bellow seal may also be operable to block first stage disk cooling air from flowing through the inner openings of the first cooling passage into the plenum.

The first and second cooling plates may be mounted on the first and second stage disks by first and second inner bayonet connections at radially inner peripheries of the first and second cooling plates respectively and each of the first and second radially inner bayonet connections include a plurality of first tabs depending radially inwardly from and circumferentially around cooling plate shaft extensions extending axially from the first and second cooling plates into an annular turbine inter-stage cavity axially located between the first and second stage disks. The inner bayonet connections further include a plurality of second tabs extending radially outwardly from and circumferentially disposed around disk shaft extensions extending axially from first and second stage bores of the first and second stage disks. The inner openings include first tab spaces between the first tabs and second tab spaces between the second tabs of the first and second inner bayonet connections respectively.

The snake bellow seal may be used in a turbine assembly having an inter-stage seal including labyrinth seal teeth mounted on a seal ring mounted to and between the first and second cooling plates, the bellow seal radially located between the inter-stage radial face spline and the seal ring, and a sealing wire disposed between a cooling plate shaft extension extending axially from the second cooling plate and the seal ring.

DETAILED DESCRIPTION OF THE INVENTION

Figure 1:
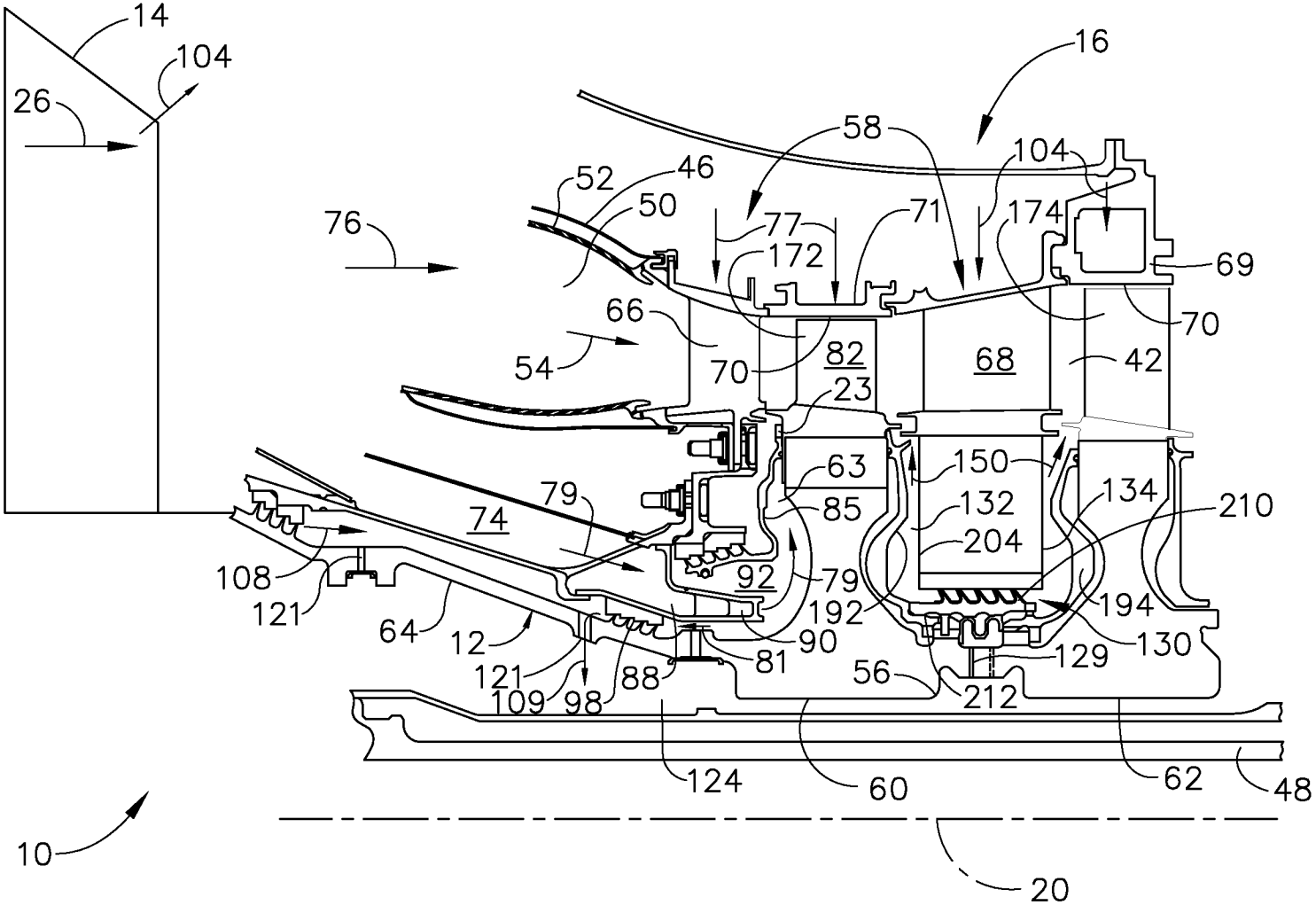
FIG. 1 is a sectional view illustration of a gas generator of a turbine engine having a compliant rotatable inter-stage seal in a turbine section of the engine.

A gas generator 10 in accordance with a preferred embodiment of the present invention is illustrated in FIG. 1. The gas generator 10 has a gas generator rotor 12 circumscribed about an axis of rotation 20 and includes a compressor 14 and a turbine 16 disposed downstream thereof.

A combustor 52 is disposed between the compressor 14 and the turbine 16. Inlet air 26 enters the compressor 14 where it is compressed by the compressor 14. The exemplary embodiment of the compressor 14 may includes a five stage axial compressor rotor and a single stage centrifugal impeller.

The inlet air 26 is compressed by the compressor 14 and exits the compressor as compressor discharge pressure (CDP) air 76. A large portion of the CDP air 76 flows into the combustor 52 where it is mixed with fuel provided by a plurality of fuel nozzles, not shown, and ignited in an annular combustion zone 50 of the combustor 52. The resulting hot combustion exhaust gases 54 pass through the turbine 16, causing rotation of a turbine rotor 56 and gas generator rotor 12. The combustion exhaust gases 54 continue downstream for further work extraction such as in a power turbine, not illustrated herein, powering and rotating an output power shaft 48 or as exhaust gas through an exhaust nozzle, also not illustrated herein. Power turbines and exhaust nozzles are conventionally known. In the exemplary embodiment illustrated herein, the turbine 16 includes the turbine rotor 56 and a turbine stator 58. The turbine rotor 56 includes a first stage disk 60 upstream from a second stage disk 62. A forward shaft 64 connects the turbine rotor 56 in rotational driving engagement to the compressor 14. Turbine stator 58 includes a first stage nozzle 66, a second stage nozzle 68 and a shroud assembly 70.

Figure 2:
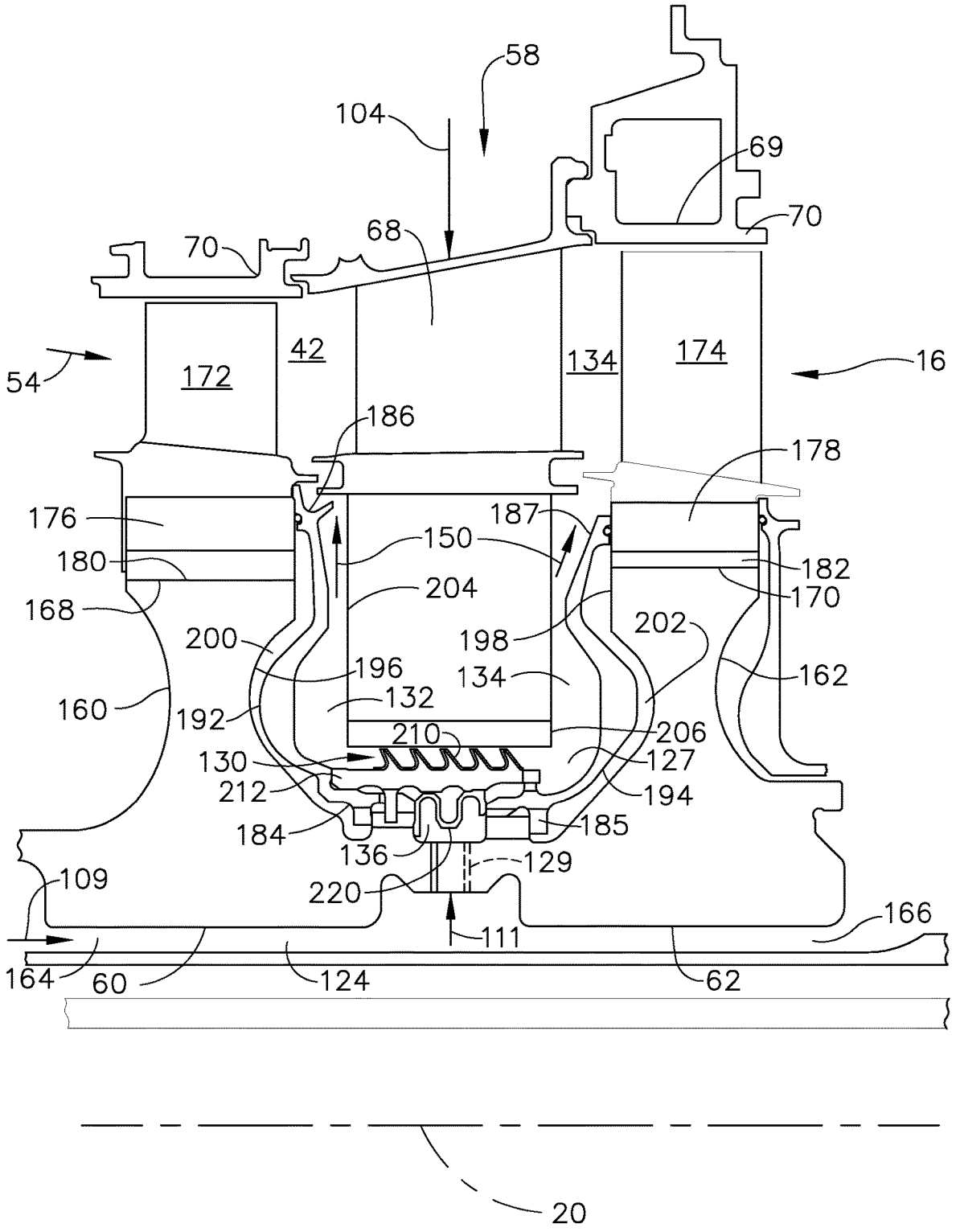
FIG. 2 is an enlarged sectional view illustration of the rotatable inter-stage seal in the turbine section illustrated in FIG. 1.

Illustrated in FIGS. 1 and 2 are cooling supply circuits for the turbine 16. Compressor discharge pressure (CDP) air 76 from the compressor 14 is flowed around a combustor heat shield 46 surrounding the combustion zone 50 and is utilized to cool components of turbine 16 subjected to the hot combustion exhaust gases 54, namely, the first stage nozzle 66, a first stage shroud 71 and the first stage disk 60. First stage nozzle cooling air 77 from the compressor 14 directly enters and cools the first stage nozzle 66 and shroud 71. First stage disk cooling air 79 may be bled from the compressor 14.

The first stage disk cooling air 79 bled in this manner is substantially free of particulate matter which could clog fine cooling passages in first stage turbine blades 172 of the first stage disk 60. The first stage disk cooling air 79 is channeled through an annular duct 74 radially inwardly into an annular manifold 88 which is in flow communication with tangential flow accelerator 90. The accelerator 90 discharges the first stage disk cooling air 79 into a first stage disk forward cavity 92 at a high tangential speed approaching wheel-speed of the first stage disk 60 at a radial position of the accelerator 90.

The first and second stage disks 60, 62 include first and second stage webs 160, 162 extending radially outwardly from first and second stage bores 164, 166 to first and second stage rims 168, 170 respectively. First and second stage turbine blades 172, 174 extend radially across a turbine flowpath 42 and include first and second stage roots 176, 178 disposed in first and second stage slots 180, 182 extending axially through the first and second stage rims 168, 170 respectively. An annular first stage forward cooling plate 85, upstream of and proximate to the first stage web 160 of the first stage disk 60, defines in part, a cooling airflow path 63 to the first stage slots 180 between the forward cooling plate 85 and the first stage web 160 of the first stage disk 60. An outer rim 23 of the forward cooling plate 85 axially retains the first stage roots 176 of the first stage turbine blades 172 in the first stage slots 180.

An additional two sources of high pressure coolant for cooling turbine components, namely, forward bleed flow 104 and aft bleed flow 108 may be bled from the compressor 14. The forward bleed flow 104 may be collected and channelled by external piping (not shown) to cool the second stage nozzle 68 and a second stage shroud 69. The forward bleed flow 104 may be used as purge flow 150 after it cools the second stage nozzle 68. The purge flow 150 flows radially outwardly between purging stage one disk aft cavity 132 and stage two disk forward cavity 134. Purging of cavities 132, 134 prevents ingestion of hot combustion exhaust gases 54 therein which, for example, could overheat the second stage rim 170 possibly resulting in release of the second stage turbine blades 174 and engine damage.

The aft bleed flow 108 may be combined with cavity leakage flow 81 from cavity 92 that flows through an inner balance piston seal 98. This combined flow 109 is discharged through a series of apertures 121 in the shaft 64 into a rotor bore 124. The combined flow 109 in bore 124 flows in a downstream direction through the rotor bore 124 between the shaft 64 and the first stage disk 60. Some of the combined flow 109 provides a turbine cooling flow 111 which passes through an inter-stage radial face spline 129, also referred to as a curvic coupling, between disk shaft extensions 131 extending axially from the first and second stage bores 164, 166 of the first and second stage disks 60, 62 respectively.

Figure 3:
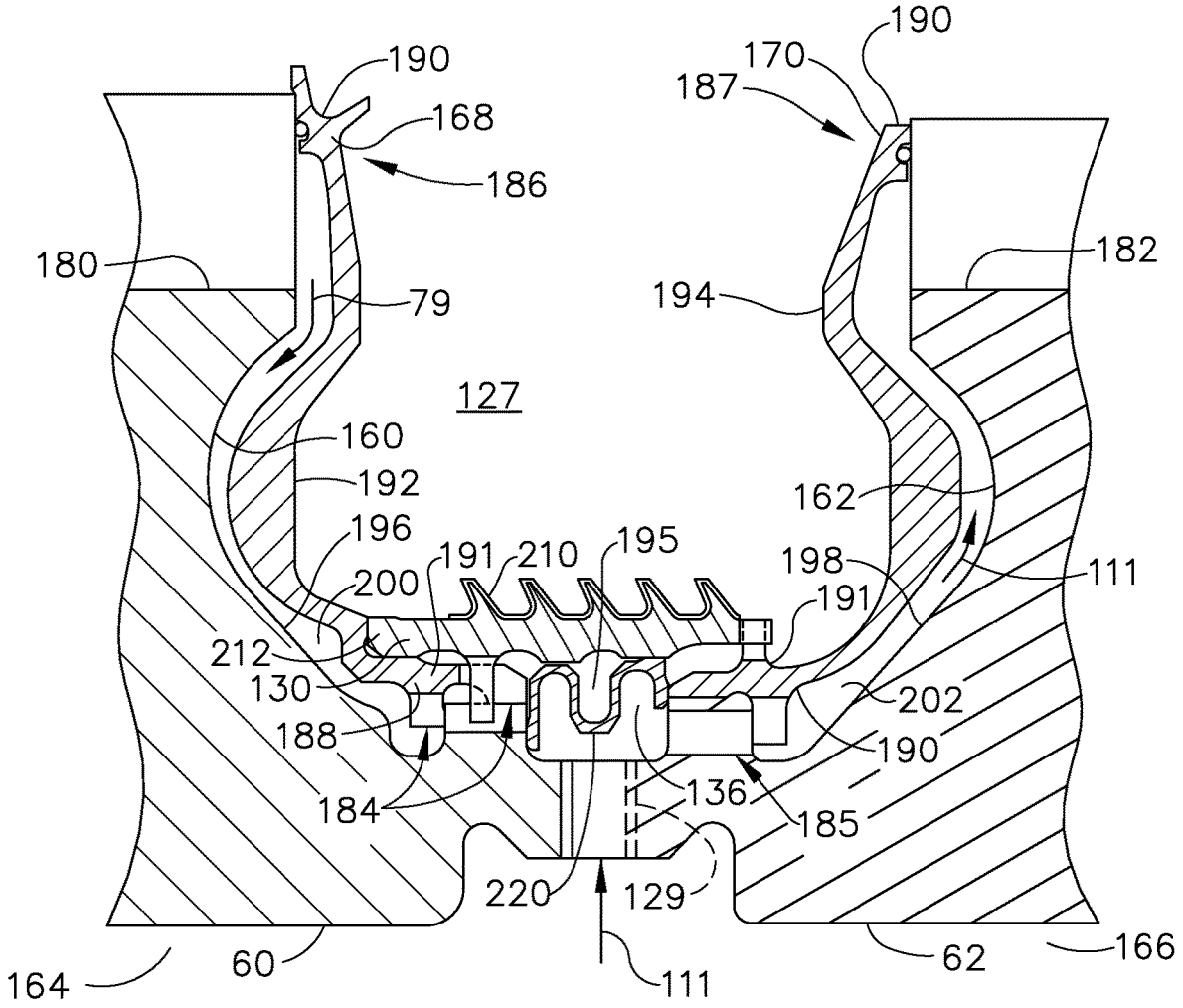
FIG. 3 is an enlarged sectional view illustration of the rotatable inter-stage seal illustrated in FIG. 2 in an annular turbine inter-stage cavity of the turbine section.

Referring to FIGS. 2 and 3, the turbine cooling flow 111 flows radially outwardly into a plenum 136 within an annular compliant bellow seal 220 circumscribed about the axis of rotation 20 and disposed between the first and second stage disks 60, 62. The turbine cooling flow 111 flows through the inter-stage radial face spline 129 (a curvic coupling) between the first and second stage disks 60, 62. The plenum 136 is axially disposed between first and second cooling plates 192, 194 mounted on aft and forward sides 196, 198 of the first and second stage webs 160, 162 of the first and second stage disks 60, 62 respectively. The first and second cooling plates 192, 194 provide first and second cooling passages 200, 202 respectively between the cooling plates and the webs as illustrated in FIGS. 2 and 3. An annular turbine inter-stage cavity 127 is defined axially between the first and second stage disks 60, 62. The first and second cooling plates 192, 194 are mounted on the first and second stage disks 60, 62 by first and second inner bayonet connections 184, 185 at radially inner peripheries 188 of the first and second cooling plates 192, 194 respectively. First and second outer sealing ends 186, 187 at radially outer peripheries 190 of the first and second cooling plates 192, 194 respectively axially aftwardly secure the first and second stage roots 176, 178 in the first and second stage slots 180, 182 extending axially through the first and second stage rims 168, 170 respectively. The first and second outer sealing ends 186, 187 seal the first and second cooling passages 200, 202 between the cooling plates and the webs at the radially outer peripheries 190. The first and second radially inner bayonet connections 184, 185 are on the first and second stage bores 164, 166 near the inter-stage radial face spline 129 at a radially inner boundary 195 of the inter-stage cavity 127.

Figure 4:
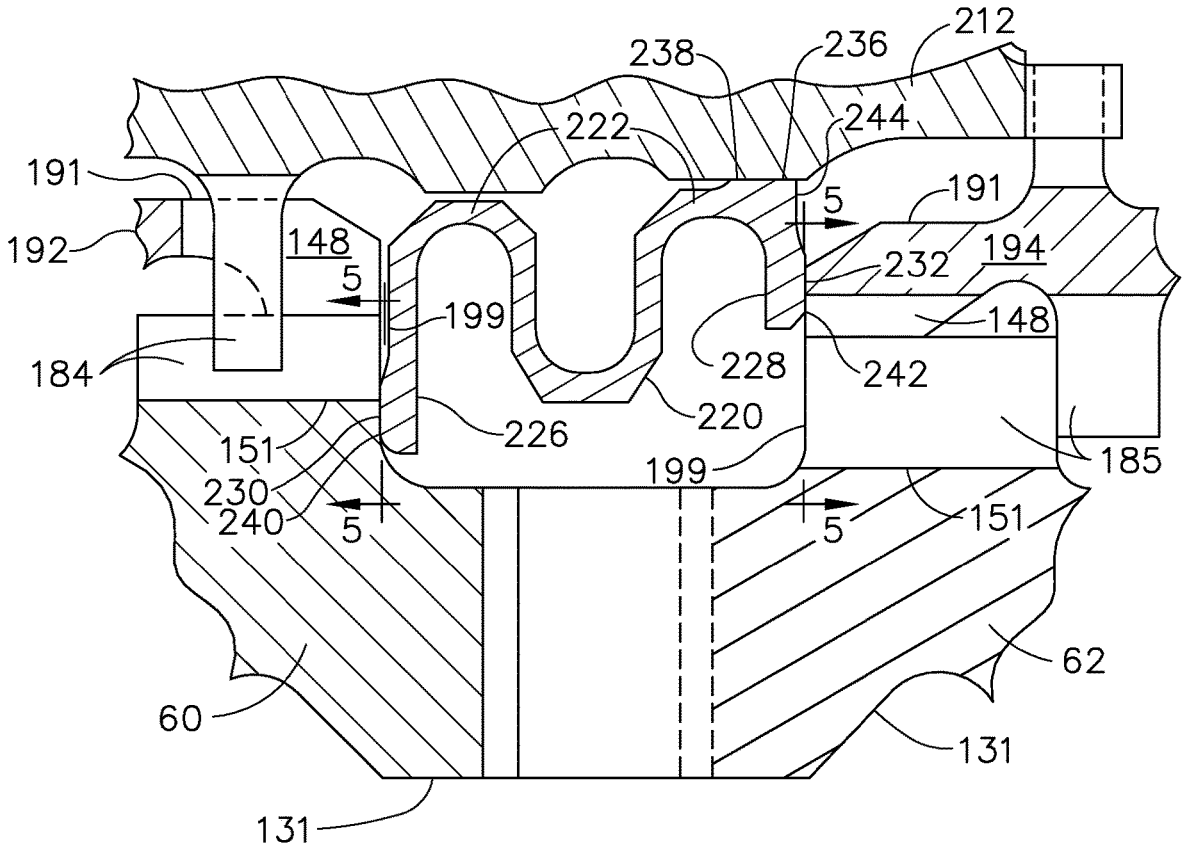
FIG. 4 is an enlarged sectional view illustration of a bellow seal as the rotatable inter-stage seal illustrated in FIG. 3.
Figure 5:
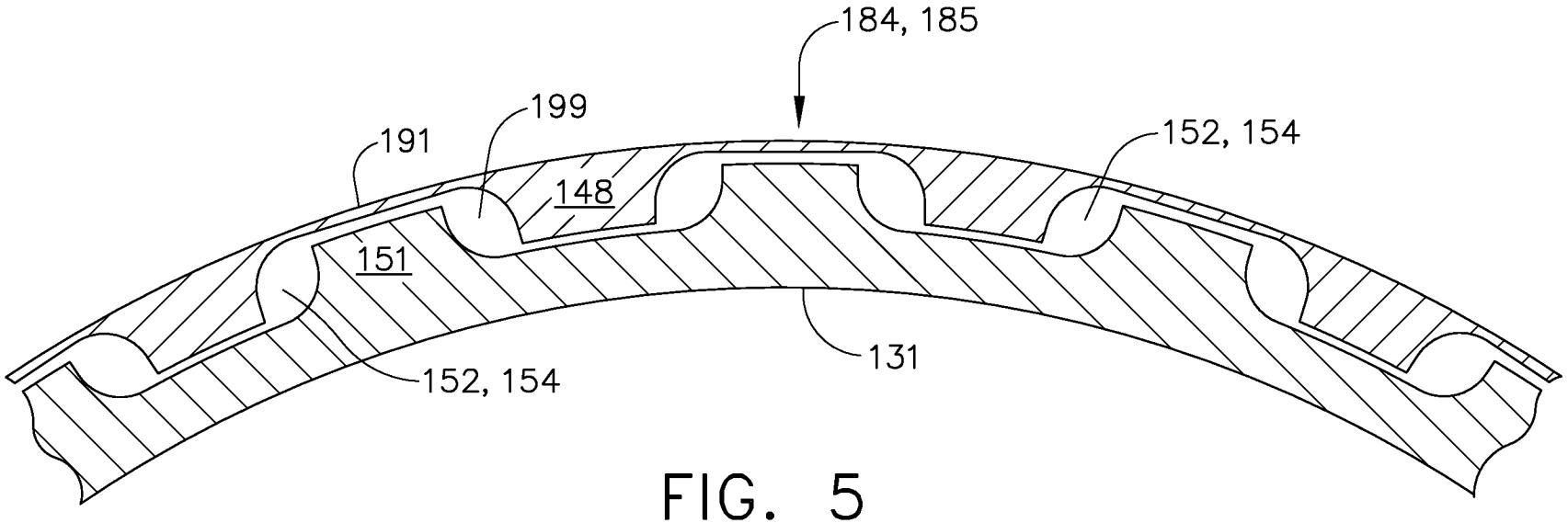
FIG. 5 is an axial view illustration of openings between tabs of bayonet connections through 5-5 in FIG. 4.

Referring to FIGS. 2-5, each of the first and second radially inner bayonet connections 184, 185 includes a plurality of first tabs 148 depending radially inwardly from and circumferentially around cooling plate shaft extensions 191. The cooling plate shaft extensions 191 extend axially from the first and second cooling plates 192, 194 into the inter-stage cavity 127. The inner bayonet connections further include a plurality of second tabs 151 extending radially outwardly from and circumferentially disposed around the disk shaft extensions 131 extending axially from the first and second stage bores 164, 166. The first and second tabs 148, 151 cooperate in interference fits in the first and second radially inner bayonet connections 184, 185. Referring to FIG. 5, first tab spaces 152 between the first tabs 148 and second tab spaces 154 between the second tabs 151 operate as inner openings 199 to the first and second cooling passages 200, 202.

Referring to FIG. 3, the first and second cooling plates 192, 194 include blade retaining first and second stage rims 168, 170 that contact the first and second stage turbine blades 172, 174 and help to axially retain them in the first and second stage slots 180, 182. The first and second cooling passages 200, 202 extend radially between the first and second stage slots 180, 182 through the first and second stage rims 168, 170 to the inner openings 199 to the first and second cooling passages 200, 202 respectively.

Referring to FIGS. 2 and 3, an inter-stage seal 130 is disposed in the inter-stage cavity 127 axially between the first and second cooling plates 192, 194 and radially between the cooling plates and the second stage nozzle 68. The inter-stage seal 130 is a labyrinth seal and includes a seal support ring 204 attached to and extending radially inwardly from the second stage nozzle 68. An annular seal land 206 is mounted radially inwardly of and to the seal support ring 204. The inter-stage seal 130 includes labyrinth seal teeth 210 sealing and engaging the seal land 206 and mounted to turbine rotor 56 by the first and second cooling plates 192, 194.

Referring to FIGS. 2-5, the annular compliant bellow seal 220 circumscribed about the axis of rotation 20 and axially disposed between, and may be in contact with, the first and second cooling plates 192, 194. The bellow seal 220 is radially located between the inter-stage radial face spline 129 and a seal ring 212 upon which are mounted the labyrinth seal teeth 210. The bellow seal 220 is operable and operably positioned to direct or allow the turbine cooling flow 111 to flow through the plenum 136 and through the inner openings 199 of the second cooling passage 202 between the second cooling plate 194 and the second stage web 162 to cool the second stage disk 62 and the second stage turbine blades 174.

The bellow seal 220 is also operable and operably positioned to block and prevent the first stage disk cooling air 79 from flowing through the first stage slots 180, the first cooling passage 200, the inner openings 199 of the first cooling passage 200, and into the plenum 136. The bellow seal 220 blocks the first stage disk cooling air 79 from flowing through the inner openings 199 of the first cooling passage 200, as may be defined by the first and second tab spaces 152, 154 associated with the first cooling passage 200, as illustrated in FIG. 5. Referring to FIG. 4, the bellow seal 220 is illustrated as having two convolutions 222, but may have more, and forward and aft annular legs or sealing walls 226, 228.

The bellow seal 220 has forward and aft sealing surfaces 230, 232 on the forward and aft annular legs or sealing walls 226, 228. The forward and aft sealing surfaces 230, 232 may be flat and substantially normal to the axis of rotation 20. The forward sealing surface 230 is positioned and operable to seal against the first stage bore 164 of the first stage disk 60. The aft sealing surface 232 is positioned and operable to seal against the cooling plate shaft extension 191 of the second cooling plate 194. The bellow seal 220 includes a radially outer contact and sealing surface 236 located on and radially facing outward from one of the convolutions 222 for allowing the bellow seal 220 to contact and radially position itself within and against the seal ring 212 of the inter-stage seal 130. The outer contact and sealing surface 236 is cylindrical and may be located on a radially outwardly extending cylindrical extension 238 on one of the convolutions 222. This provides the bellow seal 220 with axially spaced apart first and second axial sealing positions 240, 242 and a radial sealing position 244 corresponding to the forward and aft sealing surfaces 230, 232 and the radially outer contact and sealing surface 236 respectively.

Figure 6:
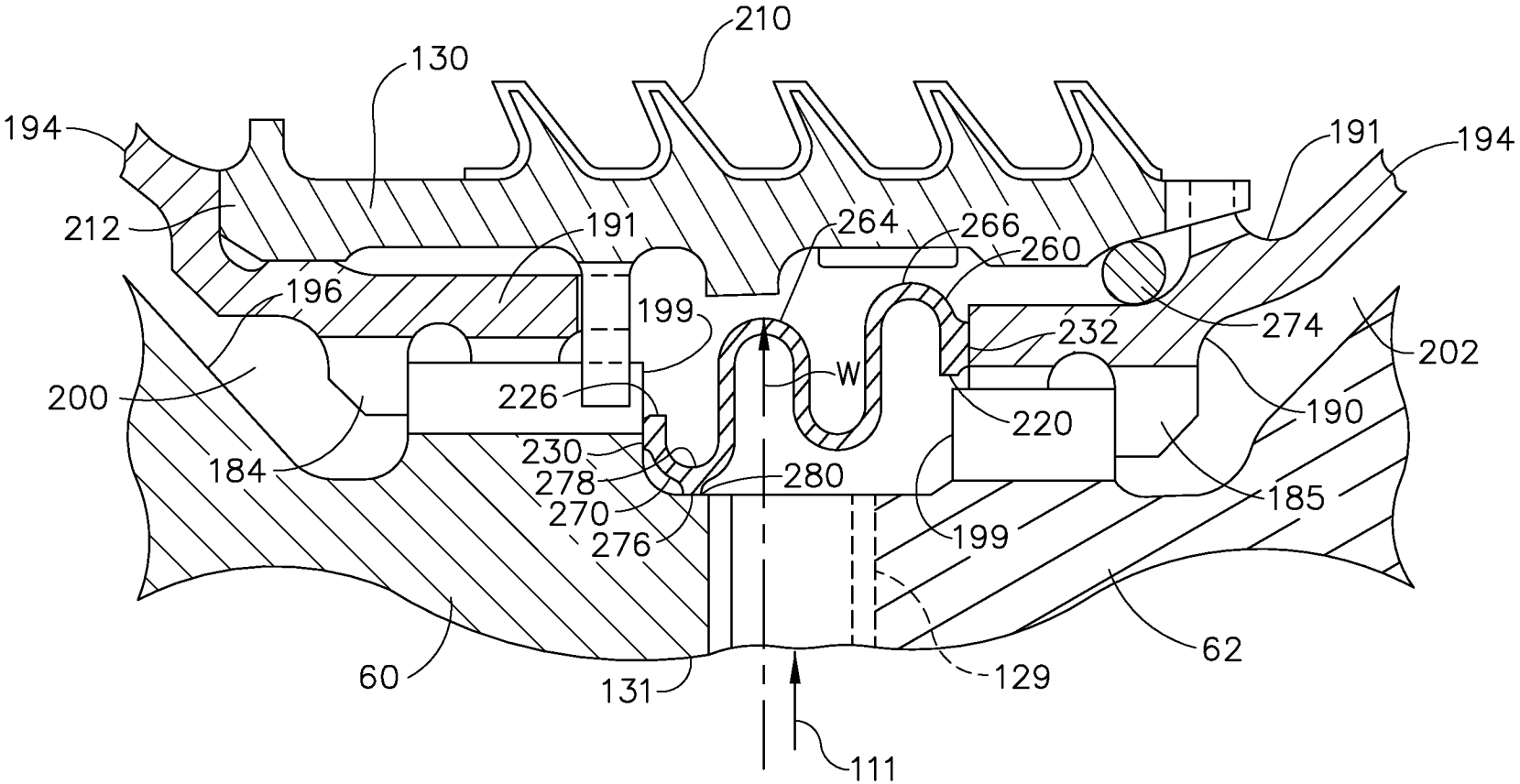
FIG. 6 is an enlarged sectional view illustration of an alternative rotatable inter-stage seal illustrated in FIG. 2 in an annular turbine inter-stage cavity of the turbine section.

A first alternative bellow seal 220 and sealing arrangement is illustrated in FIG. 6. The bellow seal 220 has a snake shape and is referred to as a snake bellow seal 260. This first embodiment of the snake bellow seal 260 includes at least two full convolutions of unequal width W, illustrated as first and second convolutions 264, 266, but may have more. The snake bellow seal 260 further includes a forwardmost partial convolution 270 which provides the forward annular leg or sealing wall 226. The second convolution 266 is an aftwardmost convolution and includes the aft annular leg or sealing wall 228. The width W of the first convolution 264 is less than the width W of the second convolution 266.

The snake bellow seal 260 has forward and aft sealing surfaces 230, 232 on the forwardmost partial convolution 270 or sealing wall 226 and the aft annular leg or sealing wall 228 respectively. The forward and aft sealing surfaces 230, 232 may be flat. The forward sealing surface 230 is positioned and operable to seal against the first stage bore 164 of the first stage disk 60. The aft sealing surface 232 is positioned and operable to seal against the cooling plate shaft extension 191 of the second cooling plate 194.

The snake bellow seal 260 further includes a radially inner contact and sealing surface 276 on a bend 278 of the forwardmost partial convolution 270 for radially positioning and sealing the snake bellow seal 260 against the disk shaft extensions 131 extending axially from the first stage bore 164 of the first stage disk 60. The radially inner contact and sealing surface 276 is cylindrical and may be located on a radially inwardly extending cylindrical extension 280 on the bend 278. A sealing wire 274 is disposed between the cooling plate shaft extensions 191 extending axially from the second cooling plate 194 and the seal ring 212 upon which the labyrinth seal teeth 210 are mounted. This design helps maintain sealing and reduce stress.

Figure 7:
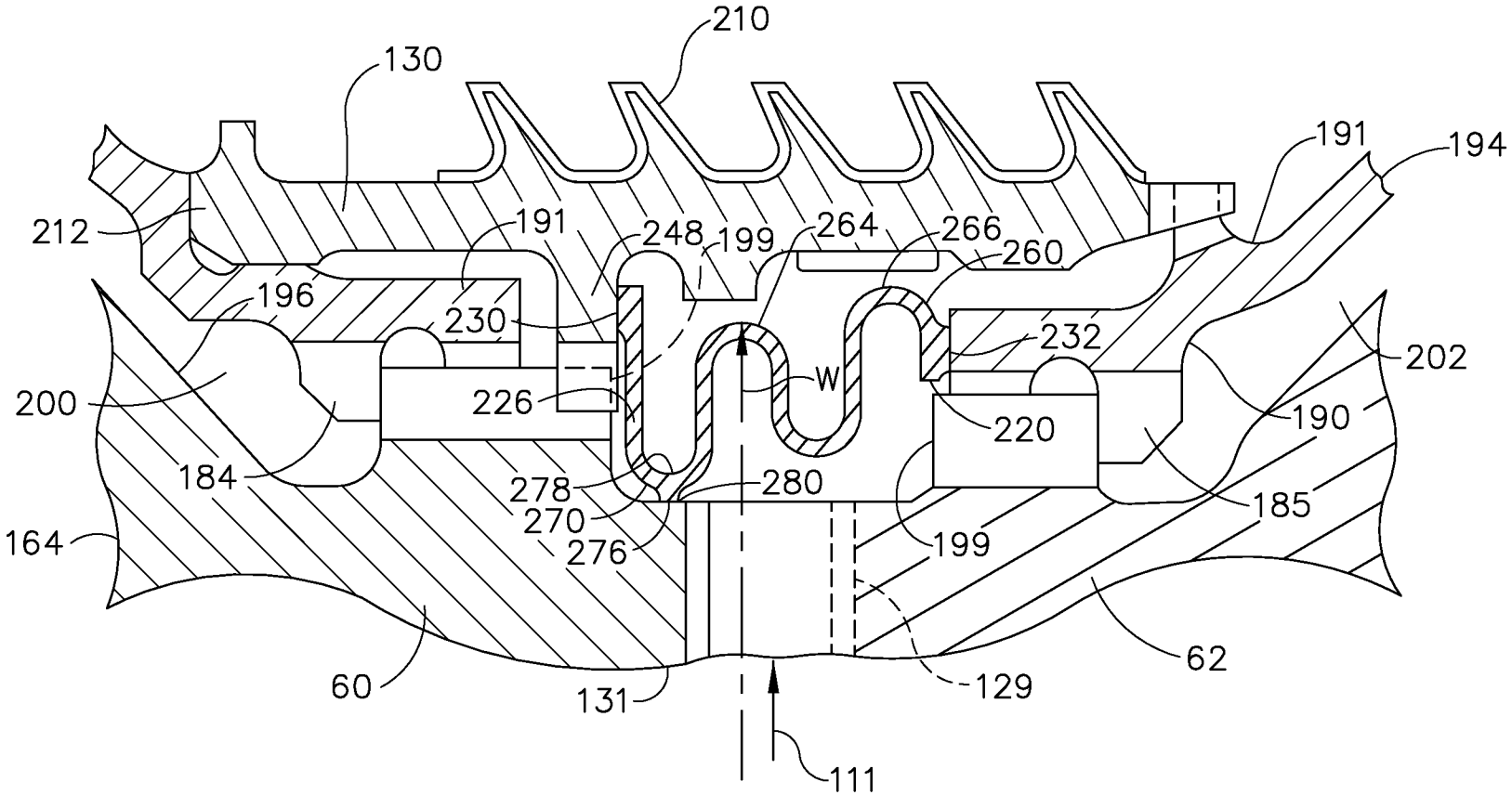
FIG. 7 is an enlarged sectional view illustration of a second alternative rotatable inter-stage seal illustrated in FIG. 2 in an annular turbine inter-stage cavity of the turbine section.

A second embodiment of the snake bellow seal 260, illustrated in FIG. 7, includes at least two full convolutions of unequal width W, illustrated as first and second convolutions 264, 266, but may have more. The snake bellow seal 260 further includes a forwardmost partial convolution 270 which provides the forward annular leg or sealing wall 226. The second convolution 266 is an aftwardmost convolution and includes the aft annular leg or sealing wall 228. The width W of the first convolution 264 is less than the width W of the second convolution 266.

The snake bellow seal 260 has forward and aft sealing surfaces 230, 232 on the forwardmost partial convolution 270 or sealing wall 226 and the aft annular leg or sealing wall 228 respectively. The forward and aft sealing surfaces 230, 232 may be flat. The forwardmost partial convolution 270 or sealing wall 226, illustrated in FIG. 7, extends radially outwardly to seal against an annular flange 248 extending radially inwardly from the inter-stage seal 130.

The second embodiment of the snake bellow seal 260 further includes a radially inner contact and sealing surface 276 on a bend 278 of the forwardmost partial convolution 270 for radially positioning and sealing the snake bellow seal 260 against the disk shaft extensions 131 extending axially from the first stage bore 164 of the first stage disk 60. The radially inner contact and sealing surface 276 is cylindrical and may be located on a radially inwardly extending cylindrical extension 280 on the bend 278. This embodiment and design helps eliminate the need for a sealing wire disposed between the cooling plate shaft extensions 191 extending axially from the second cooling plate 194 and the seal ring 212 upon which the labyrinth seal teeth 210 are mounted. This design helps maintain sealing and reduce stress.

It is therefore desired to be secured in the appended claims all such modifications as fall within the true spirit and scope of the invention. Accordingly, what is desired to be secured by Letters Patent of the United States is the invention as defined and differentiated in the following claims.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed:

1. A compliant bellow seal comprising:

two or more convolutions circumscribed about an axis of rotation with at least one convolution extending radially inward and with at least one convolution extending radially outward, oppositely facing forward and aft sealing surfaces on axially spaced apart forward and aft annular legs or sealing walls, and a cylindrical annular contact and sealing surface on and facing radially outwardly or inwardly with respect to the axis of rotation, from one of the convolutions.

2. The bellow seal as claimed in claim 1, further comprising the outer contact and sealing surface being located on a radially outwardly extending cylindrical extension on one of the convolutions.

3. The bellow seal as claimed in claim 1, further comprising the forward and aft sealing surfaces being flat.

4. The bellow seal as claimed in claim 3, further comprising the outer contact and sealing surface being located on a radially outwardly extending cylindrical extension on one of the convolutions.

5. The bellow seal as claimed in claim 1, further comprising:

the bellow seal being a snake bellow seal, at least two of the convolutions being full convolutions of unequal width, and a forwardmost partial convolution including the forward annular leg or sealing wall.

6. The bellow seal as claimed in claim 5, further comprising the outer contact and sealing surface being located on a radially inwardly extending cylindrical extension on a bend of the forwardmost partial convolution.

7. The bellow seal as claimed in claim 5, further comprising the forward and aft sealing surfaces being flat.

8. The bellow seal as claimed in claim 7, further comprising the outer contact and sealing surface being located on a radially inwardly extending cylindrical extension on a bend of the forwardmost partial convolution.

9. A turbine assembly comprising:

first and second cooling plates mounted on first and second stage disks respectively, first and second cooling passages disposed between the first and second cooling plates and the first and second stage disks respectively, the first and second cooling plates and the first and second stage disks circumscribed about an axis of rotation, an annular compliant bellow seal circumscribed about the axis of rotation with at least one convolution extending radially inward and with at least one convolution extending radially outward and axially disposed between the first and second cooling plates, the bellow seal including two or more convolutions circumscribed about the axis of rotation, oppositely facing forward and aft sealing surfaces on axially spaced apart forward and aft annular legs or sealing walls, and a cylindrical annular outer and inner contact and sealing surfaces on and facing radially outwardly or inwardly with respect to the axis of rotation from one of the convolutions.

10. The turbine assembly as claimed in claim 9, further comprising the outer contact and sealing surface being located on a radially outwardly extending cylindrical extension on one of the convolutions.

11. The turbine assembly as claimed in claim 9, further comprising the forward and aft sealing surfaces being flat.

12. The turbine assembly as claimed in claim 9, further comprising the forward sealing surface positioned and operable to seal against a first stage bore of the first stage disk and the aft sealing surface positioned and operable to seal against a cooling plate shaft extension of the second cooling plate.

13. The turbine assembly as claimed in claim 11, further comprising the outer contact and sealing surface being located on a radially outwardly extending cylindrical extension on one of the convolutions.

14. The turbine assembly as claimed in claim 9, further comprising:

the bellow seal being a snake bellow seal, at least two of the convolutions being full convolutions of unequal width, and a forwardmost partial convolution including the forward annular leg or sealing wall.

15. The turbine assembly as claimed in claim 14, further comprising:

an inter-stage seal including labyrinth seal teeth mounted on a seal ring mounted to and between the first and second cooling plates, the bellow seal radially located between the inter-stage radial face spline and the seal ring, the forward sealing surface positioned and operable to seal against an annular flange extending radially inwardly from the inter-stage seal, and a first stage bore of the first stage disk and the aft sealing surface positioned and operable to seal against a cooling plate shaft extension of the second cooling plate.

16. The turbine assembly as claimed in claim 14, further comprising the outer contact and sealing surface being located on a radially inwardly extending cylindrical extension on a bend of the forwardmost partial convolution.

17. The turbine assembly as claimed in claim 9, further comprising:

the bellow seal surrounding an inter-stage radial face spline between disk shaft extensions extending axially from the first and second stage bores of the first and second stage disks respectively, the inner openings to the first and second cooling passages respectively, the bellow seal operable to direct or allow turbine cooling flow from the inter-stage radial face spline to flow through the plenum and through the inner openings of the second cooling passage, and the bellow seal operable to block first stage disk cooling air from flowing through the inner openings of the first cooling passage into the plenum.

18. The turbine assembly as claimed in claim 17, further comprising:

the first and second cooling plates mounted on the first and second stage disks by first and second inner bayonet connections at radially inner peripheries of the first and second cooling plates respectively, each of the first and second radially inner bayonet connections including a plurality of first tabs depending radially inwardly from and circumferentially around cooling plate shaft extensions extending axially from the first and second cooling plates into an annular turbine inter-stage cavity axially located between the first and second stage disks, the inner bayonet connections further including a plurality of second tabs extending radially outwardly from and circumferentially disposed around disk shaft extensions extending axially from first and second stage bores of the first and second stage disks, and the inner openings including first tab spaces between the first tabs and second tab spaces between the second tabs of the first and second inner bayonet connections respectively.

19. The turbine assembly as claimed in claim 18, further comprising the outer contact and sealing surface being located on a radially outwardly extending cylindrical extension on one of the convolutions.

20. The turbine assembly as claimed in claim 19, further comprising the forward and aft sealing surfaces ng flat.

21. The turbine assembly as claimed in claim 18, further comprising:

the bellow seal being a snake bellow seal, at least two of the convolutions being full convolutions of unequal width, and a forwardmost partial convolution including the forward annular leg or sealing wall.

22. The turbine assembly as claimed in claim 21, further comprising the outer contact and sealing surface being located on a radially inwardly extending cylindrical extension on a bend of the forwardmost partial convolution.

23. The turbine assembly as claimed in claim 21, further comprising:

an inter-stage seal including labyrinth seal teeth mounted on a seal ring mounted to and between the first and second cooling plates, the bellow seal radially located between the inter-stage radial face spline and the seal ring, and a sealing wire disposed between a cooling plate shaft extension extending axially from the second cooling plate and the seal ring.

24. The turbine assembly as claimed in claim 23, further comprising the forward sealing surface positioned and operable to seal against a first stage bore of the first stage disk and the aft sealing surface positioned and operable to seal against a cooling plate shaft extension of the second cooling plate.

* * * * *